US005509977A

United States Patent [19]

Yano et al.

[11] Patent Number: 5,509,977

[45] Date of Patent: Apr. 23, 1996

[54] HIGH STRENGTH HOT ROLLED STEEL PLATES AND SHEETS EXCELLENT IN UNIFORM ELONGATION AFTER COLD WORKING AND PROCESS FOR PRODUCING THE SAME

[75] Inventors: Seinosuke Yano; Koh Moriyama; Takashi Harabuchi; Yoshikazu Nakano; Hiroshi Mochiki; Kimio Nagata, all of Kitakyusyu, Japan

[73] Assignees: Japan Casting & Forging Corporation; Nippon Steel Corporation, both of Tokyo, Japan

[21] Appl. No.: 256,224

[22] PCT Filed: Oct. 29, 1993

[86] PCT No.: PCT/JP93/01580

§ 371 Date: Jun. 24, 1994

§ 102(e) Date: Jun. 24, 1994

[87] PCT Pub. No.: WO94/10355

PCT Pub. Date: May 11, 1994

[30] Foreign Application Priority Data

Oct. 30, 1992 [JP] Japan ..... 4-292352

[51] Int. Cl.[6] ..... C22C 38/14; C21D 7/13; C21D 8/02

[52] U.S. Cl. ..... 148/328; 148/602; 148/654

[58] Field of Search ..... 148/602, 654, 148/661, 328; 420/126

[56] References Cited

U.S. PATENT DOCUMENTS 4,880,480 11/1989 Kokubu et al. .
5,181,974 1/1993 Tanabe et al. .
5,192,376 3/1993 Tanabe et al. .

FOREIGN PATENT DOCUMENTS 58-19430 2/1983 Japan ..... 148/602
62-27519 2/1987 Japan .
62-174323 7/1987 Japan ..... 148/654
2-267222 11/1990 Japan .
3-79716 4/1991 Japan .

*Primary Examiner*—Deborah Yee
*Attorney, Agent, or Firm*—Kenyon & Kenyon

[57] ABSTRACT

The present invention provides hot rolled steel plates and sheets having a tensile strength of 34 to 62 kgf/mm$^2$ and excellent in a uniform elongation even after cold working the steel plates and sheets to give round and square tubes, shapes, sheet piles, etc., to such an ordinary degree that the productivity is not lowered, and a process for producing the hot rolled steel plates and sheets. The hot rolled steel plates and sheets contain from 0.04 to 0.25% of C, from 0.0050 to 0.0150% of N and from 0.003 to 0.050% of Ti, also contain from 0.0008 to 0.015% of TiN having a particle size exceeding 1 μm and dispersed in the matrix thereof, and have Ceq. (WES) of 0.10 to 0.45%. The process comprises heating a steel slab containing the constituents as mentioned above to 1,000 to 1,300° C., starting to roll the steel slab subsequently and finishing rolling at a temperature of at least the $Ar_3$ transformation point, and air cooling from a temperature of at least 500° C. or coiling at a temperature of at least 500° C. and air cooling, the resultant steel structure having a pearlite phase in an amount of 5 to 20% in terms of area fraction.

8 Claims, 2 Drawing Sheets

×400

×400

HIGH STRENGTH HOT ROLLED STEEL PLATES AND SHEETS EXCELLENT IN UNIFORM ELONGATION AFTER COLD WORKING AND PROCESS FOR PRODUCING THE SAME

FIELD OF THE INVENTION

The present invention relates to hot rolled steel plates and sheets for general structure purposes and welded structure purposes excellent in uniform elongation after cold working and having high tensile strength, and a process for producing the same.

BACKGROUND OF THE INVENTION

With the significant progress of the quality and production technology of hot rolled steel plates and sheets for structure uses in recent years, demand for steel products excellent in plastic deformability has increased more and more, particularly in the field of architecture and civil engineering from the standpoint of anti-earthquake design, and steel plates and sheets are now required to have a high strength, a low yield ratio and a high uniform elongation.

To respond to the requirement, Kokai (Japanese Unexamined Patent Publication) No. 57-16118, for example, discloses a process for producing electric welded tubes of low yield ratio, for oil wells, in which the carbon content is increased to 0.26 to 0.48%, and Kokai (Japanese Unexamined Patent Publication) No. 57-16119 discloses a process for producing high tensile strength electric welded tubes of low yield ratio in which the carbon content is from 0.10 to 0.20%. In either of these processes, electric welded tubes requiring no heat treatment are prepared by producing a hot rolled steel plate or sheet of low yield ratio, and cold working the steel product while the strain amount is being restricted so that the amount of work hardening does not become large. Moreover, Kokai (Japanese Unexamined Patent Publication) No. 4-176818 proposes a process for producing steel tubes or square tubes excellent in anti-earthquake properties by hot working a strainless ferrite-pearlite dual phase structure, controlling the cooling rate after hot working, and heat treating. However, all those processes mentioned above greatly lower the productivity and, in addition, the former processes markedly impair the weldability. Accordingly, those processes currently do not necessarily answer the requirements of the industrial field.

In addition to the disclosures mentioned above, Kokai (Japanese Unexamined Patent Publication) No. 4-48048 and Kokai (Japanese Unexamined Patent Publication) No. 4-99248 disclose techniques for improving the toughness of weld heat-affected region by dispersing oxide inclusions in a steel matrix. The oxide inclusions in the former patent publication are 0.5 μm or less in particle size and have (Ti, Nb) (O, N) composite crystal phases. The oxide inclusions in the latter patent publication are 1 μm or less in particle size and have Ti(O, N) composite crystal phases. The techniques of these patent publications are essentially different from that of the present invention with regard to dispersion phases and objects.

In general, a steel having a higher strength exhibits a higher yield ratio and a lower ductility, and therefore its uniform elongation is lowered. Especially when the steel is cold worked to give round and square tubes, shape steels, sheet piles, etc., its uniform elongation is markedly lowered because of the influence of work hardening caused by work strain.

The present invention has been achieved to solve the problems as described above, and an object of the present invention is to provide hot rolled steel plates and sheets excellent in uniform elongation and having a high tensile strength (at least 34 kgf/mm$^2$) even after subjecting them to cold working to give round and square tubes, shapes, sheet piles, etc., to such an ordinary degree that the productivity is not lowered.

DISCLOSURE OF THE INVENTION

To achieve the objects as described above, the present inventors have investigated in detail the relationship between the chemical constituents and crystal structures of steel and mechanical properties thereof, the relationship between the mechanical properties of the steel after cold working and those of the as rolled steel, and the like. As a result, the present inventors have obtained the following knowledge: in the case of a steel for general structure uses and welded structure, especially a hot rolled steel plate or sheet having a tensile strength of 34 to 62 kgf/mm$^2$ which is used in the greatest amount in architecture and civil engineering, the relationship between the tensile strength and uniform elongation of as hot rolled product (uniform elongation lowering with an increase in the tensile strength) approximately agrees with the relationship between them after cold working, and both relationships can be approximated by the same curve; although both as hot rolled steel and cold worked steel exhibit an increase in the strength and a decrease in the uniform elongation with an increase in N in the steel, the uniform elongation can be recovered, and a high uniform elongation can be obtained even when the steel has a high strength by further adding Ti, the relationships as mentioned above not holding in this case.

Such knowledge is further illustrated below by making reference to FIG. 2.

FIG. 2 is a graph showing relationships between TS (tensile strength, kgf/mm$^2$) and Elu (uniform elongation, %) obtained from as hot rolled steel products and cold worked ones (square tubes) using steels S-1 (comparative example), S-2 (comparative example), T-1 (example) and T-2 (example) as listed in Table 1, S-1, T-1 and T-2 being produced by production process B as shown in Table 2, and S-2 being produced by production process C. The amounts of both Ti and N in S-1 are less than the lower limits of the present invention. Though the amount of N in S-2 is within the range of the present invention, the amount of Ti is low and less than the lower limit thereof. In production process C, the rolling finishing temperature is low and less than the $Ar_3$ transformation point.

In FIG. 2, with regard to the relationship between TS and Elu, the as hot rolled plates or sheets of S-1 exhibit high TS and Elu. However, the square tubes of S-1 exhibit drastically lowered Elu with an increase in TS.

In the case of S-2, the relationship is more significant. The as hot rolled steel plates or sheets exhibit 10% or less Elu when TS is high though they may exhibit high Elu when TS is low. Square tubes prepared by cold working exhibit 10% or less Elu in most cases, and further lowered Elu as TS increases.

That is, in the case of S-1 and S-2, the cold worked steel products exhibit a tendency of drastically lowering Elu with an increase in TS.

On the other hand, in the case of T-1 and T-2, the as hot rolled steel plates or sheets exhibit almost no lowering of Elu even when TS increases. Cold worked products obtained therefrom exhibit lowering of Elu to a slight degree, and suffer almost no influence of an increase in TS.

That is, the steel of the present invention containing added N and Ti in suitable amounts exhibits almost no lowering of the uniform elongation with an increase in the tensile strength even after cold working. Especially, a steel of the invention having TS of at least 47 kgf/mm$^2$ can exhibit the effect of the invention. As described above, the steel of the invention has excellent properties as a steel for general structural purposes and welded structure.

The present invention has been achieved based on the knowledge as described above, and the subject matter of the invention is high strength hot rolled steel plates and sheets having a tensile strength of 34 to 62 kgf/mm$^2$ and excellent in uniform elongation after cold forming, the steel plates and sheets containing from 0.040 to 0.25% of C, from 0.0050 to 0.0150% of N and from 0.003 to 0.050% of Ti, also containing 0.0008 to 0.015% of TiN having an average size exceeding 1 μm and dispersed in the matrix thereof, and having a Ceq. (WES) of 0.10 to 0.45%, the steel plates and sheets being prepared by heating a steel slab containing the constituents as described above to 1,000° to 1,300° C. for hot rolling, rolling the slab, finishing rolling at a temperature of at least the $Ar_3$ transformation point, and air cooling the rolled product to a temperature of at least 500° C. or coiling the rolled product to a temperature of at least 500° C. and air cooling the coiled product to form a pearlite phase in the steel structure in an amount of 5 to 20% in terms of area fraction, and a process for producing the same.

BEST MODE FOR PRACTICING THE INVENTION

Figure 1A:
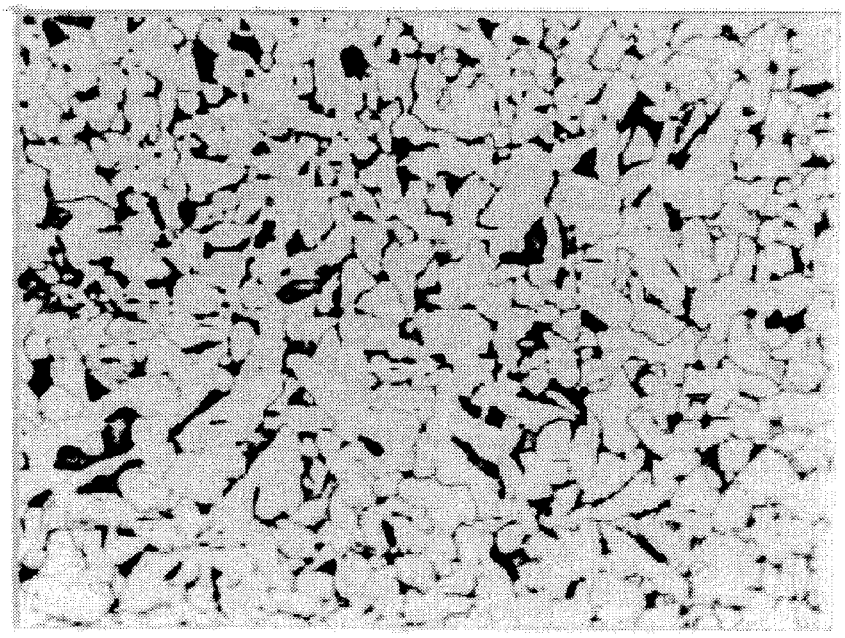
FIG. 1(A) shows a photomicrograph (magnification: 400) illustrating the metal structure of a flat portion of a square tube obtained from a steel of the invention [No. T-2 (MID portion) steel in Table 4 containing 15.2% of a pearlite phase].

The present invention is illustrated below in detail.

In the present invention, a low alloy steel slab composed of 0.040 to 0.25% of C, 0.0050 to 0.0150% of N, 0.003 to 0.050% of Ti, with a carbon equivalent (Ceq.) being in the range from 0.10 to 0.45%, and the balance Fe and unavoidable impurities is firstly manufactured by a conventional production step of continuously casting molten steel prepared by a melting furnace such as a converter or an electric furnace or making the molten steel to an ingot and blooming the ingot.

In the present invention, constituents in the steel are specified as described above for reasons as described below.

C is an important constituent for determining the strength of steel and the amount of a pearlite phase in the steel structure. When a hot rolled steel sheet having a tensile strength of at least 34 kgf/mm$^2$ contains less than 5% of a pearlite phase in terms of area fraction in the steel structure, the uniform elongation after cold forming is markedly lowered. This is because the pearlite engages in the strength of the steel, prevents an increase in the dislocation density and maintains the plastic deformability. To obtain such a steel structure, the steel is required to contain at least 0.04% of C. However, since the weldability of the steel is impaired when its C content exceeds 0.25%, the upper limit of the C content is defined to be 0.25%.

N added to the steel is dissolved in the ferrite matrix, increases the strength of the steel, and lowers the plastic deformability. However, when N is added together with Ti, TiN is formed. The formation thereof not only decreases dissolved N in the steel and improves the plastic deformability but also functions to dispersion strengthen the steel. N is therefore an important element for imparting high strength and a large uniform elongation to the steel. To impart such properties thereto, it is necessary that TiN having an average particle size exceeding 1 μm should be dispersed in the matrix in an amount of 0.0008 to 0.015% by weight. To obtain the above TiN, an amount of Ti in the range from 0.03 to 0.050% is effective. Namely, when the average particle size of TiN is 1 μm or less, dispersion strengthening is not sufficiently effected.

Moreover, though the necessary amount of N is at least 0.0050%, preferably at least 0.0080%, the strengthening becomes excessive and the uniform elongation is lowered when the amount of N exceeds 0.0150%. Accordingly, the upper limit of the amount of N is defined to be 0.0150%. In addition, to effectively form TiN mentioned above in the steel, it is preferable that the steel should be deoxidized with Al added thereto prior to the addition of Ti.

Ti is added to the steel of the present invention for reasons as described above, and the amount is preferably from 0.01 to 0.03%.

The carbon equivalent (Ceq.) is obtained by the following formula (based on WES):

$$Ceq.=C+Si/24+Mn/6+Ni/40+Cr/5+Mo/4+V/14.$$

The amount of Ceq. is specified in relation to the strength and the weldability. When the amount is less than 0.10%, sufficient strength cannot be ensured. When the amount exceeds 0.45%, the weldability is impaired though a high strength can be obtained. Accordingly, Ceq. is restricted to the range from 0.10 to 0.45%.

The steel may contain as an effective constituent for improving the strength and toughness at least one element selected from the group consisting of 0.01 to 0.7% of Si, 0.1 to 2.0% of Mn, 0.05 to 1.0% of Ni, 0.05 to 1.0% of Cr, 0.02 to 0.5% of Mo and 0.005 to 0.2% of V.

In addition, P and S contained in the steel slab of the present invention are harmful impurities which lower the toughness, the weldability, etc. Accordingly, the amount of P and that of S are each restricted to 0.025% or less, and P+S is restricted to 0.04% or less.

Furthermore, the steel of the present invention may contain as an effective constituent for improving the strength and toughness at least one member selected from the group consisting of 0.05 to 1.0% of Cu, 0.005 to 0.05% of Nb, 0.001 to 0.1% of Al, 0.0005 to 0.0020% of B, 0.0005 to 0.0070% of Ca and 0.001 to 0.050% of REM (rare-earth metals in lanthanide series including Y).

A steel slab of low alloy steel whose constituents are adjusted in the range as described above is heated to 1,000° to 1,300° C. for the purpose of hot rolling and is rolled, and the rolling is finished at a steel temperature of at least the $Ar_3$ transformation point. The resultant steel is air cooled to a temperature of at least 500° C. to obtain a steel plate, or coiled at a coiling temperature of at least 500° C. and air cooled to obtain a hot rolled steel strip.

The lower limit of the heating temperature for hot rolling is defined to be 1,000° C. to prevent an increase in the strength and a decrease in the plastic deformability caused as described below: the rolling finishing temperature of the steel may be less than the $Ar_3$ transformation point depending on the steel thickness; as a result the ferrite therein may forcibly be worked, and the dislocation density in the matrix is then increased. When the steel slab temperature exceeds 1,300° C., the yield of the product is markedly lowered due to oxidation thereof. Accordingly, the upper limit is defined to be 1300° C. The rolling finishing temperature is defined to be at least the $Ar_3$ transformation point for reasons as described above. Moreover, for the purpose of avoiding an unnecessary increase of the strength of the steel plates and sheets of the invention, the air cooling-starting temperature and coiling temperature after rolling are defined to be at least 500° C.

In the steel plate and sheet produced according to the present invention, TiN having an average particle size exceeding 1 μm is finely dispersed and precipitated in the matrix in a proportion of 0.0008 to 0.015%. As a result, the steel exhibits a fine grain ferrite-pearlite structure (partly containing a bainitic structure) containing a pearlite phase in an amount of 5 to 20% in terms of area fraction as shown in FIG. 1(A). Since the steel plate and sheet of the invention have such a steel structure, they are excellent in a uniform elongation after cold working and have a high tensile strength of 34 to 62 kgf/mm$^2$.

EXAMPLES

Examples of the present invention will be illustrated below.

TiN-containing steel slabs having chemical compositions as shown in Table 1 and comparative steels were hot rolled into plates and sheets having a thickness of 3.0 to 22.2 mm, and the mechanical properties of the resultant steel plates and sheets were investigated. The production processes are shown in Table 2. The properties of the steel products which were rolled or worked to have 10% of a strain are shown in Table 3.

Figure 1B:
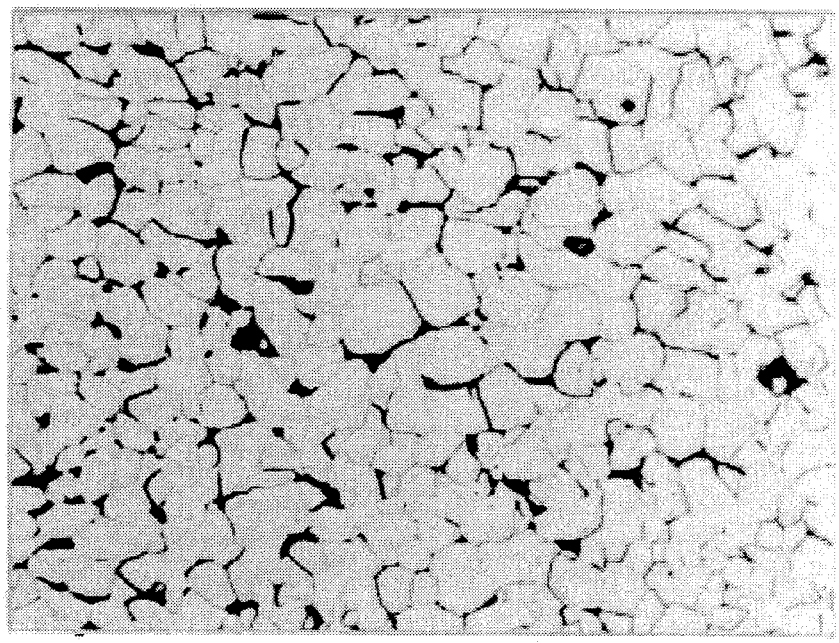
FIG. 1(B) shows a photomicrograph (magnification: 400) illustrating the metal structure of a flat portion of a square tube obtained from a comparative steel [No. S-2 steel (thickness (t)=3.2 mm) in Table 4 containing 4% of a pearlite phase].
Figure 2:
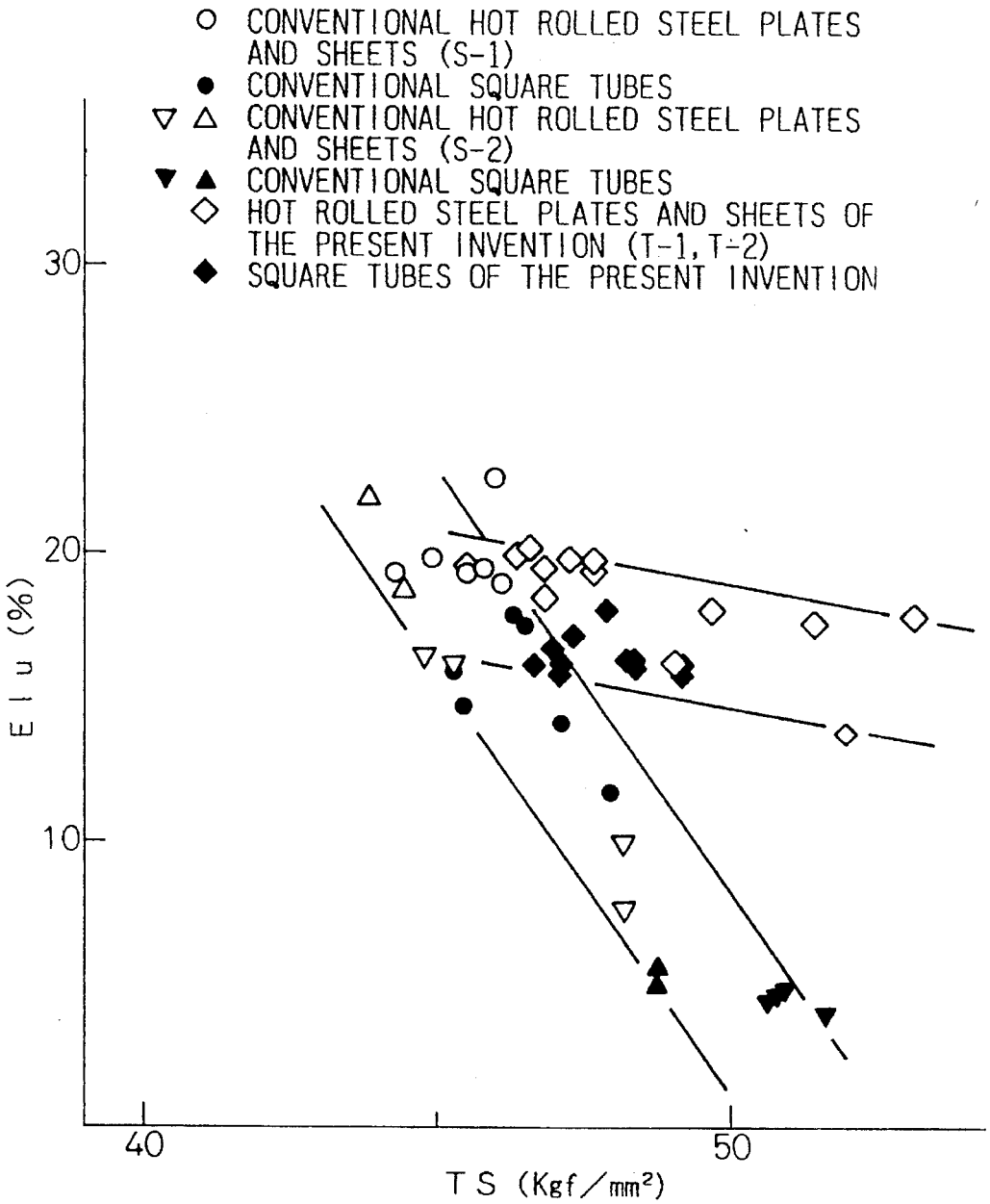
FIG. 2 shows the relationship between the tensile strength and the uniform elongation of various hot rolled steel sheets and square tubes in Table 4.

Tables 4 and 5 show the results of investigating properties of each of sites in the as rolled steels and square tubes prepared therefrom. FIG. 1(A) shows the photomicrograph (x400) of the metal structure of the flat portion (MID) of a square tube prepared from steel T-2 in the present invention, and FIG. 1(B) shows that of the metal structure of comparative steel S-2. In the steel of the invention in FIG. 1(A), the amount of the pearlite phase was approximately 15.2% in terms of area fraction, whereas the comparative steel in FIG. 1(B) contained it in an extremely small amount of about 4%. FIG. 2 shows the relationship between the tensile strength and the uniform elongation of the steels in the present invention and that of the comparative steels for comparison, with the results in Table 4 principally utilized.

It is evident from these results that the steels of the present invention (C-4, C-6, T-1, T-2, T-3, T-4) maintained a large uniform elongation particularly after cold working though the strength is high compared with the respective comparative steels. The results can be well understood from FIG. 2 in which there are shown the relationship between the uniform elongation and the strength of the hot rolled plates and sheets of the steels of the invention and the comparative steels and the relationship therebetween of square tubes obtained by cold forming the plates and sheets mentioned above in an actual production line.

TABLE 1

| | | (wt %) | | | | | | | | | | | | | |
|---|---|---|---|---|---|---|---|---|---|---|---|---|---|---|---|
| Steel | | C | Si | Mn | P | S | Cu | Ni | Cr | Mo | V | Al | Ti | N | Ceq |
| CS | C-1 | 0.16 | 0.05 | 0.45 | 0.009 | 0.007 | — | — | 0.11 | 0.02 | — | 0.025 | — | 0.0027 | 0.26 |
| CS | C-2 | 0.16 | 0.05 | 0.45 | 0.009 | 0.017 | — | — | 0.11 | 0.03 | — | 0.030 | — | 0.0034 | 0.26 |
| CS | C-3 | 0.15 | 0.05 | 0.44 | 0.010 | 0.016 | — | — | 0.07 | 0.02 | — | 0.026 | — | 0.0071 | 0.24 |
| IS | C-4 | 0.15 | 0.05 | 0.45 | 0.010 | 0.017 | — | — | 0.07 | 0.02 | — | 0.027 | 0.015 | 0.0071 | 0.24 |
| CS | C-5 | 0.08 | 0.07 | 0.31 | 0.012 | 0.017 | 0.20 | 0.59 | 0.06 | 0.10 | 0.01 | 0.027 | 0.001 | 0.0058 | 0.19 |
| IS | C-6 | 0.08 | 0.08 | 0.28 | 0.010 | 0.016 | 0.21 | 0.60 | 0.05 | 0.11 | 0.01 | 0.012 | 0.012 | 0.0092 | 0.18 |
| CS | C-7 | 0.08 | 0.07 | 0.30 | 0.010 | 0.017 | 0.20 | 0.57 | 0.05 | 0.09 | 0.01 | 0.023 | 0.011 | 0.0167 | 0.18 |
| CS | S-1 | 0.14 | 0.01 | 0.46 | 0.013 | 0.003 | — | — | — | — | — | 0.032 | — | 0.0015 | 0.22 |
| CS | S-2 | 0.12 | 0.09 | 0.29 | 0.016 | 0.022 | — | — | 0.05 | — | 0.005 | 0.038 | 0.001 | 0.0074 | 0.18 |
| CS | S-3 | 0.15 | 0.39 | 1.40 | 0.012 | 0.013 | — | — | 0.05 | — | — | 0.033 | — | 0.0040 | 0.41 |
| CS | S-4 | 0.06 | 0.04 | 0.33 | 0.009 | 0.010 | — | — | 0.03 | — | — | 0.034 | — | 0.0110 | 0.12 |
| IS | T-1 | 0.15 | 0.09 | 0.27 | 0.014 | 0.019 | — | — | 0.05 | — | 0.006 | 0.039 | 0.016 | 0.0111 | 0.21 |
| IS | T-2 | 0.17 | 0.09 | 0.28 | 0.011 | 0.015 | — | — | 0.06 | — | 0.007 | 0.030 | 0.021 | 0.0110 | 0.23 |
| IS | T-3 | 0.15 | 0.38 | 1.39 | 0.013 | 0.013 | — | — | 0.06 | — | — | 0.031 | 0.022 | 0.0100 | 0.41 |
| IS | T-4 | 0.05 | 0.05 | 0.39 | 0.010 | 0.010 | — | — | 0.06 | — | — | 0.031 | 0.027 | 0.0090 | 0.13 |

Note:
CS = Comparative steel; IS = Steel of the present invention
Ceq. (WES) = C + Si/24 + Mn/6 + Ni/40 + Cr/5 + Mo/4 + V/14

TABLE 2

| | (Temperature: °C.) | | | |
|---|---|---|---|---|
| Production process | Steel slab heating temp. | Rolling finishing temp. | Steel sheet coiling temp. | Air cooling starting temp. |
| IS A | 1200 | 950 | 680 | — |
| IS B | 1230 | 880 | 630 | — |
| CS C | 1230 | 790* | 490 | — |
| IS D | 1180 | 900 | — | 700 |

Note:
(1) IS = Steel of the present invention; CS = Comparative steel
(2) *Temperature being lower than the Ar3 transformation point

TABLE 3

| Steel | Process | Thickness (mm) | YS1* (kgf/mm²) | TS* (kgf/mm²) | El* (%) | ELu* (%) | Note |
|---|---|---|---|---|---|---|---|
| CS C-1 | A | 5.7 | 31.1 | 43.0 | 42.0 | 22.2 | as rolled |
| | | 5.4 | 48.5 | 48.5 | 28.0 | 7.2 | 10% strained |
| CS C-2 | A | 5.7 | 29.2 | 43.7 | 43.5 | 21.6 | as rolled |
| | | 5.4 | 49.3 | 49.8 | 26.0 | 5.2 | 10% strained |
| CS C-3 | A | 5.7 | 31.2 | 44.8 | 40.5 | 21.0 | as rolled |
| | | 5.4 | 52.1 | 52.8 | 23.0 | 2.0 | 10% strained |
| IS C-4 | A | 5.7 | 32.6 | 46.0 | 44.0 | 20.0 | as rolled |
| | | 5.4 | 52.6 | 53.3 | 31.0 | 9.0 | 10% strained |
| CS C-5 | A | 8.5 | 24.5 | 34.6 | 47.0 | 22.8 | as rolled |
| | | 6.9 | 42.4 | 43.3 | 21.0 | 1.2 | 10% strained |
| IS C-6 | A | 8.7 | 25.0 | 35.4 | 45.5 | 22.0 | as rolled |
| | | 6.9 | 43.5 | 46.3 | 26.0 | 6.4 | 10% strained |
| CS C-7 | C | 8.5 | 41.5 | 48.8 | 34.0 | 17.5 | as rolled |
| | | 6.9 | 57.0 | 57.8 | 20.1 | 1.4 | 10% strained |

Note:
IS = Steel of the present invention; CS = Comparative steel
pieces being prepared in accordance with the JIS Z 2201 5 test piece

TABLE 4

| Steel | Process | Thickness (mm) | YS1* (kgf/mm²) | TS* (kgf/mm²) | El* (%) | ELu* (%) | Note |
|---|---|---|---|---|---|---|---|
| CS S-1 | B | 3.2 | 31.3 | 45.3 | 39.0 | 19.2 | as rolled |
| | | 3.3 | 45.0 | 47.8 | 33.2 | 11.6 | sq. tube F |
| | B | 3.2 | 31.8 | 45.9 | 39.2 | 18.8 | as rolled |
| | | 3.2 | 38.4 | 46.3 | 36.0 | 17.3 | sq. tube F |
| | B | 6.0 | 31.9 | 44.7 | 40.6 | 19.7 | as rolled |
| | | 6.1 | 40.4 | 45.3 | 37.0 | 14.5 | sq. tube F |
| CS S-2 | C | 3.2 | 34.0 | 44.6 | 34.8 | 16.3 | as rolled |
| | | 3.2 | 48.1 | 51.5 | 20.4 | 4.0 | sq. tube F |
| | C | 6.0 | 39.8 | 48.1 | 29.0 | 9.8 | as rolled |
| | | 6.0 | 46.3 | 50.8 | 23.6 | 4.9 | sq. tube F |
| | C | 5.7 | 31.7 | 44.2 | 38.0 | 18.7 | as rolled |
| | | 5.8 | 43.2 | 48.7 | 29.0 | 5.5 | sq. tube F |
| IS T-1 | B | 3.0 | 32.1 | 45.3 | 39.5 | 19.5 | as rolled (TOP) |
| | | 3.1 | 38.7 | 46.8 | 36.0 | 16.6 | sq. tube F (TOP) |
| | B | 3.0 | 30.3 | 46.4 | 40.0 | 20.0 | as rolled (MID) |
| | | 3.1 | 38.1 | 47.1 | 36.5 | 17.0 | sq. tube F (MID) |
| | B | 3.1 | 34.4 | 51.2 | 34.0 | 17.5 | as rolled (BOT) |
| | | 3.1 | 42.8 | 51.8 | 31.0 | 13.6 | sq. tube F (BOT) |
| | B | 3.1 | 65.3 | 71.9 | 28.0 | 6.2 | sq. tube C (BOT) |
| | | 3.1 | 60.9 | 65.5 | 32.0 | 7.9 | sq. tube C (BOT) |
| IS T-2 | B | 3.0 | 34.7 | 48.9 | 40.0 | 19.8 | as rolled (TOP) |
| | | 3.1 | 38.4 | 48.2 | 35.0 | 16.0 | sq. tube F (TOP) |
| | B | 3.0 | 30.9 | 47.3 | 37.0 | 19.4 | as rolled (MID) |
| | | 3.1 | 38.8 | 48.1 | 35.0 | 16.2 | sq. tube F (MID) |
| | B | 3.1 | 33.3 | 52.9 | 35.0 | 17.6 | as rolled (BOT) |
| | | 3.1 | 39.4 | 49.0 | 35.0 | 16.0 | sq. tube F (BOT) |
| | B | 3.1 | 60.8 | 67.4 | 33.0 | 12.0 | sq. tube C (BOT) |
| | | 3.1 | 59.3 | 66.5 | 35.0 | 12.3 | sq. tube C (BOT) |

Note:
IS = Steel of the present invention; CS = Comparative steel
tensile test pieces being prepared in accordance with the JIS Z 2201 5 test piece except for corner portions test pieces of which were prepared in accordance with the JIS Z 2201 12B test piece
*tubes of each of the types having each a dimension of 75 mm × 75 mm

TABLE 5

| Steel | Process | Thickness (mm) | 0.2% PS* (kgf/mm$^2$) | TS* (kgf/mm$^2$) | El* (%) | ELu* (%) | Note |
|---|---|---|---|---|---|---|---|
| CS S-3 | D | 22.2 | 36.0 | 54.9 | 28.4 | 20.0 | as rolled |
| | | 22.0 | 38.1 | 56.0 | 24.7 | 16.6 | sq. tube F |
| | | 22.1 | 57.1 | 66.2 | 15.0 | 5.2 | sq. tube C |
| CS S-4 | C | 9.0 | 30.0 | 43.0 | 40.0 | 17.5 | as rolled |
| | | 9.1 | 38.2 | 45.8 | 35.0 | 9.5 | sq. tube F |
| | | 9.0 | 48.9 | 54.1 | 26.0 | 4.2 | sq. tube C |
| IS T-3 | D | 22.1 | 36.2 | 55.1 | 29.0 | 21.3 | as rolled |
| | | 22.0 | 38.5 | 56.2 | 27.1 | 18.7 | sq. tube F |
| | | 22.0 | 57.3 | 66.3 | 20.6 | 12.7 | sq. tube C |
| IS T-4 | B | 8.9 | 29.3 | 45.0 | 38.5 | 20.5 | as rolled |
| | | 9.0 | 34.2 | 45.3 | 38.0 | 19.6 | sq. tube F |
| | | 9.0 | 50.3 | 56.5 | 36.0 | 16.0 | sq. tube C |

Note:
IS = Steel of the present invention; CS = Comparative steel
S-3, T-3: square tubes each having a dimension of 350 mm × 350 mm, tensile test pieces being prepared in accordance with the JIS Z 2201 1B test piece
S-4, T-4: square tubes each having a dimension of 250 mm × 250 mm, tensile test pieces being prepared in accordance with the JIS Z 2201 5 test piece

POSSIBILITY OF UTILIZATION IN THE INDUSTRY

As described above, in the present invention, high strength hot rolled steel plates and sheets having a tensile strength of 34 to 62 kgf/mm$^2$ and extremely excellent in a uniform elongation even after being subjected to cold forming to such a degree that the ordinary productivity is not lowered can be produced by specifying the constituents in the steel to form relatively large TiN particles having a dispersion strengthening capability, and forming an effective pearlite phase therein. The high strength hot rolled plates and sheets are extremely useful as steel products for general structure uses and welded structure, and materials for round and square tubes, shapes, sheet piles, etc.

We claim:

1. High strength hot rolled steel plates and sheets excellent in uniform elongation after cold working, containing from 0.04 to 0.25% by weight of C, from 0.0050 to 0.0150% by weight of N and from 0.003 to 0.050% of Ti, having a carbon equivalent (Ceq.) defined by the formula described below of 0.10 to 0.45% and a pearlite phase in an amount of 5 to 20% in terms of area fraction, and containing from 0.0008 to 0.015% by weight of TiN having an average particle size exceeding 1 μm and dispersed therein:

$$Ceq.=C+Si/24+Mn/6+Ni/40+Cr/5+Mo/4+V/14.$$

2. The high strength hot rolled steel plates and sheets according to claim 1, wherein the tensile strength is from 34 to 62 kgf/mm$^2$.

3. The high strength hot rolled steel plates and sheets according to claim 1, wherein the plates and sheets contain at least one constituent selected from the group consisting of 0.01 to 0.7% by weight of Si, 0.1 to 2.0% by weight of Mn, 0.05 to 1.0% by weight of Ni, 0.05 to 1.0% by weight of Cr, 0.02 to 0.5% by weight of Mo and 0.005 to 0.2% by weight of V.

4. The high strength hot rolled steel plates and sheets according to claim 1, wherein the plates and sheets further contain at least one constituents selected from the group consisting of 0.05 to 1.0% by weight of Cu, 0.005 to 0.05% by weight of Nb, 0.001 to 0.1% by weight of Al, 0.0005 to 0.0020% by weight of B, 0.0005 to 0.0070% by weight of Ca and 0.001 to 0.050% by weight of REM.

5. The high strength hot rolled steel plates and sheets according to claim 1, wherein the contents of P and S are controlled to satisfy the following conditions:

$P \leqq 0.025\%$ by weight, $S \leqq 0.025\%$ by weight, and $P+S \leqq 0.04\%$ by weight.

6. A process for producing high strength hot rolled steel plates and sheets excellent in uniform elongation after cold working, which comprises heating a steel slab containing from 0.04 to 0.25% by weight of C, from 0.0050 to 0.0150% by weight of N and from 0.003 to 0.050% by weight of Ti, and having a carbon equivalent (Ceq.) of 0.10 to 0.45% to a temperature from 1000° to 1300° C., starting to roll the heated steel slab and finishing rolling at a temperature of at least the $Ar_3$ transformation point, and air cooling from a temperature of at least 500° C.

7. The process according to claim 6, wherein a plate is produced by air cooling the product from a temperature of at least 500° C.

8. The process according to claim 6, wherein a steel strip is produced by coiling the product at a temperature of at least 500° C. and air cooling.

* * * * *